United States Patent [19]

Tardy et al.

[11] 4,044,795

[45] Aug. 30, 1977

[54] SELECTIVE AND PROPORTIONAL HYDRAULIC REMOTE CONTROL DEVICE, IN PARTICULAR FOR HANDLING AND PUBLIC WORK GEARS

[75] Inventors: Maurice Tardy; Jean Paulet, both of Saint-Etienne, France

[73] Assignee: Bennes Marrel, France

[21] Appl. No.: 542,173

[22] Filed: Jan. 20, 1975

[30] Foreign Application Priority Data

May 31, 1974 France ..... 74.19652

[51] Int. Cl.[2] ..... F15B 13/042

[52] U.S. Cl. ..... 137/625.6; 137/625.68; 137/625.3

[58] Field of Search ..... 137/625.3, 625.38, 625.61, 137/625.64, 625.68, 625.6

[56] References Cited

U.S. PATENT DOCUMENTS

| | | | |
|---|---|---|---|
| 624,890 | 5/1899 | Batchelor | 251/30 |
| 1,431,101 | 10/1922 | Dineen | 137/625.68 |
| 2,910,050 | 10/1959 | Dotter et al. | 137/625.68 X |
| 3,129,645 | 4/1964 | Olmsted | 137/625.64 X |
| 3,340,897 | 9/1967 | Nevulis | 137/625.6 |
| 3,736,958 | 6/1973 | Rostad | 137/625.64 X |
| 3,862,643 | 1/1975 | Dezelan et al. | 137/625.3 X |

FOREIGN PATENT DOCUMENTS

| | | | |
|---|---|---|---|
| 721,904 | 1/1955 | United Kingdom | 137/625.68 |
| 518,867 | 3/1940 | United Kingdom | 137/625.68 |
| 151,663 | 9/1920 | United Kingdom | 137/625.68 |
| 7,937 | 2/1899 | United Kingdom | 137/625.68 |

*Primary Examiner*—Alan Cohan
*Assistant Examiner*—Gerald A. Michalsky
*Attorney, Agent, or Firm*—Irving M. Weiner; Pamela S. Austin

[57] ABSTRACT

A selective and proportional hydraulic remote control device including jacks which are connected to a high pressure oil circuit commutated by distributors. The distributors are remotely controlled by a low pressure circuit which is connected to a fluid emitter. The emitter causes the input flow of the low pressure circuit for the distributors to vary. Only the input to the low pressure circuit takes place from the emitter through connections, while the return to the tank takes place from the distributors through jets, the sections of which are fixed. The same distributor can be controlled from several different locations.

1 Claim, 5 Drawing Figures

24
18
25
26
27
21
22
19
20
28
17
23
32
30
33
34
35
31
36
29

SELECTIVE AND PROPORTIONAL HYDRAULIC REMOTE CONTROL DEVICE, IN PARTICULAR FOR HANDLING AND PUBLIC WORK GEARS

The present invention relates to a fluid control device. Particularly, the invention relates to a hydraulic control device for remote control, in particular, for public works gears and handling gears.

BACKGROUND OF THE INVENTION

Hydraulic control devices are known, which include power members controlled by a high pressure circuit connected with a slide valve distributor. Said distributor is remotely controlled by a hand-operated fluid emitter, with which it is connected through a low pressure circuit.

Said low pressure circuit includes an inlet jet, the section of which is constant, and an outlet jet, the section of which can be varied. The outlet jet is therefore always disposed in the emitter.

This arrangement has some drawbacks, in that the response time of the control device is not short. Moreover, a distributor can only be controlled from a single emitter.

One of the objects of the present invention is to provide a control device, the response time of which is shorter, and which allows simplifying the equipment in some cases, whereby the cost is reduced. Moreover, the present invention allows multiplying the number of remotely controlling emitters for the same distributor.

SUMMARY OF THE INVENTION

The present invention provides a fluid control device which comprises in combination a fluid emitter including body means and piston means. A source of fluid is operably connected to the fluid emitter. The body means includes a first port, a second port, and a third port. The piston means is mounted in the body means for displacement therein. The piston means is normally biased to a first position so that fluid from said source of fluid is introduced into the fluid emitter through the first port and is permitted to leave the fluid emitter through the second port. The piston means is movable by an external force to a second position so that the fluid from the source of fluid is permitted to enter the fluid emitter through the first port and to leave the fluid emitter through the third port. The piston means is provided with control means for varying the effective fluid communication passageway between the first port and the third port.

A selective and proportional hydraulic control device according to the invention includes an emitter which allows in particular the admission of fluid sent under low pressure towards a distributor which performs the commutation of the high pressure circuit towards the power members, such as jacks or the like, and said hydraulic control device is characterized in that control means are provided for adjusting the section of the port of admission to the distributor, that is, the driving pressure, while the section of the outlet port is constant.

According to another feature of the invention, the control means which allow adjusting the section of the inlet port of the distributor are grouped inside the emitter, the latter being constituted by a body provided with at least one hollow piston, which slides inside an axial bore in which calibrated holes are radially drilled, while the position of a control lever defines the number of holes being obturated, the unobturated holes defining the section of the inlet port by opening into a pressure chamber.

According to another feature of the invention, the outlet port of the low pressure circuit lies in the emitter, the latter being then so-called "emitter connected up, in use, with the fluid tank."

According to a modified embodiment, the outlet port of the low pressure circuit lies in the distributor, and the emitter is then so-called "emitter not connected up, in use, with the fluid tank."

According to a further modified embodiment, at least two outlet ports are simultaneously provided, the one on the emitter, and the other on the distributor.

According to another feature of the invention, the low pressure circuit acts on at least one piston connected to the slide valve of the distributor to control the commutation of the low pressue circuit, said piston being provided with a hole parallel to the longitudinal axis thereof, said hole being provided with a jet through which a controlled passage of the low pressure circuit takes place, and the distributor is so-called "distributor piloted by the pistons."

According to a modified embodiment, the low pressuire circuit acts directly on the slide valve of the distributor, said slide valve including a hole along its longitudinal axis, said hole being provided with a jet through which a controlled passage of the low pressure circuit takes place, and the distributor is so-called "distributor piloted directly by the slide valve."

According to a further modified embodiment a single distributor is controlled by at least two emitters of the type called "emitter not connected up, in use, with the fluid tank."

According to a further modified embodiment, a single emitter controls at least two distributor simultaneously.

BRIEF DESCRIPTION OF THE DRAWINGS

The accompanying drawing, which is given by way of non-limiting example, will allow understanding the features of the invention more clearly.

DETAILED DESCRIPTION OF SOME PREFERRED EMBODIMENTS OF THE PRESENT INVENTION

Before explaining the present invention in detail, it is to be understood that the invention is not limited in its application to the details of construction and arrangement of parts illustrated in the accompany drawings, because the invention is capable of other embodiments and of being practiced or carried out in various ways. Also, it is to be understood that the phraseology or terminology employed herein is for the purpose of description and not of limitation.

Figure 1:
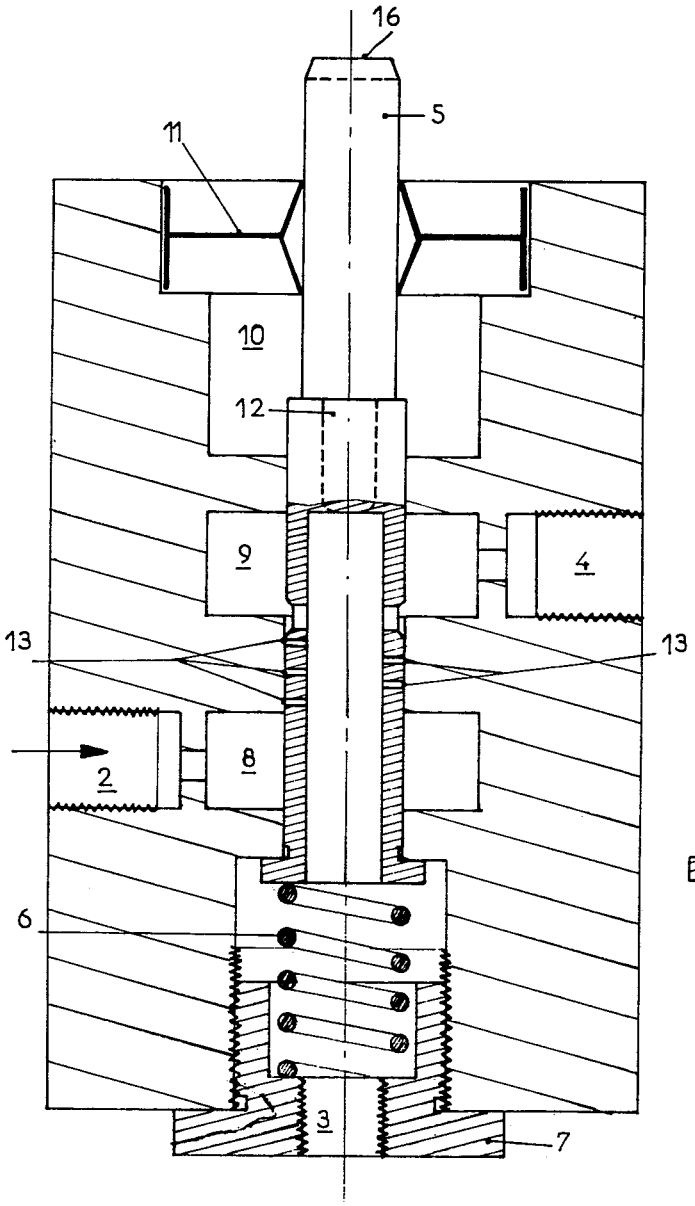
FIG. 1 is an axial section of a fluid emitter according to the invention.

Referring to the drawings, and particularly to FIG. 1, there is shown a fluid control device according to a first embodiment of the present invention, which fluid control device comprises a fluid emitter.

The fluid emitter shown in FIG. 1 is of the type called "connected up, with the fluid tank." The fluid emitter includes a body means, such as a body provided with a first port of low pressure oil inlet 2, a third port or outlet 3 connected with the distributor (not shown), and a second port 4 through which the oil can return to the oil tank. Piston means, including a piston 5, slides inside the body. The piston 5 is held butting in translation by a spring 6, which bears against the screwed plug 7. The piston 5 may be in the shape of a spindle, the lower half of which is hollowed-out as a blind bore which opens on the port 3. Said piston 5 passes through three chambers which are indicated from bottom upwards by 8, 9 and 10. The chamber 8 is connected with the oil inlet 2. The chamber 9 with the oil return port 4. The upper part of the chamber 10 is obturated by the sealing ring 11. A flat part 12 machined in the piston 5 provides a permanent connection between the chambers 9 and 10.

Figure 2:
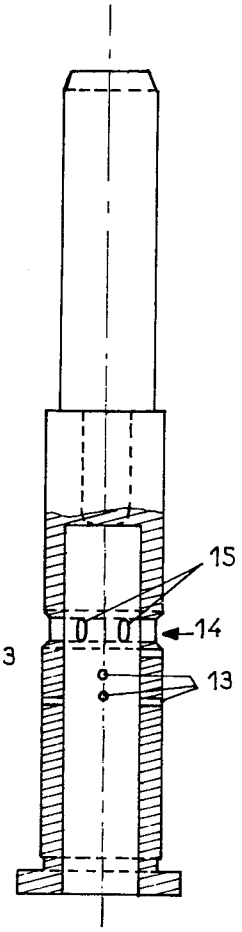
FIG. 2 is a section of a piston of said emitter.

The novelty lies, first of all, in the bores 13 which are drilled in the piston 5, perpendicularly to the axis of the latter, and directed from the outside to the blind bore. The piston 5 includes, besides, a groove 14 into which holes 15 open, the diameter of said holes 15 being greater than that of the holes or ports 13 (FIG. 2).

In the position as shown in FIG. 1, the holes or ports 13 are obturated by a bore in the body, and the groove 14 opens into the chamber 9.

The operation of said emitter is as follows :

When a manually operated device presses the face 16 of the piston 5 in an axial direction, said piston 5 moves downwardly in translation, while compressing the spring 6. Depending on the intensity of the force applied on the face 16, the piston 5 moves to a greater or lesser extent, and a greater or smaller number of ports 13 come to open into the chamber 8. The low pressure oil from the inlet 2 is thus able to flow towards the feeding port 3 through a "port", the section of which is capable of varying. Said section is the sum of the sections of the uncovered holes or ports 13. The nomenclature "effective fluid communication passageway" as used herein also has reference to the sum of the sections of the uncovered holes or ports 13.

When the first of the ports 13 is lying opposite the chamber 8, the groove 14 is masked by a bore in the body.

When no force is exerted on the piston 5, the latter is held in butting opposition by the spring 6 (FIG. 1), the groove 14 opens into the chamber 9, and the holes 15 enable the oil from the distributor to return to the oil tank (not shown) through the port 4. This return port 4 has thus a constant or fixed section.

According to a modified embodiment, the only holes drilled radially in the distributor piston are the holes 13, so that the low pressure oil can only pas from the emitter to the distributor. The emitter is then called "not connected up, in use, with the tank."

Figures 3, 4:
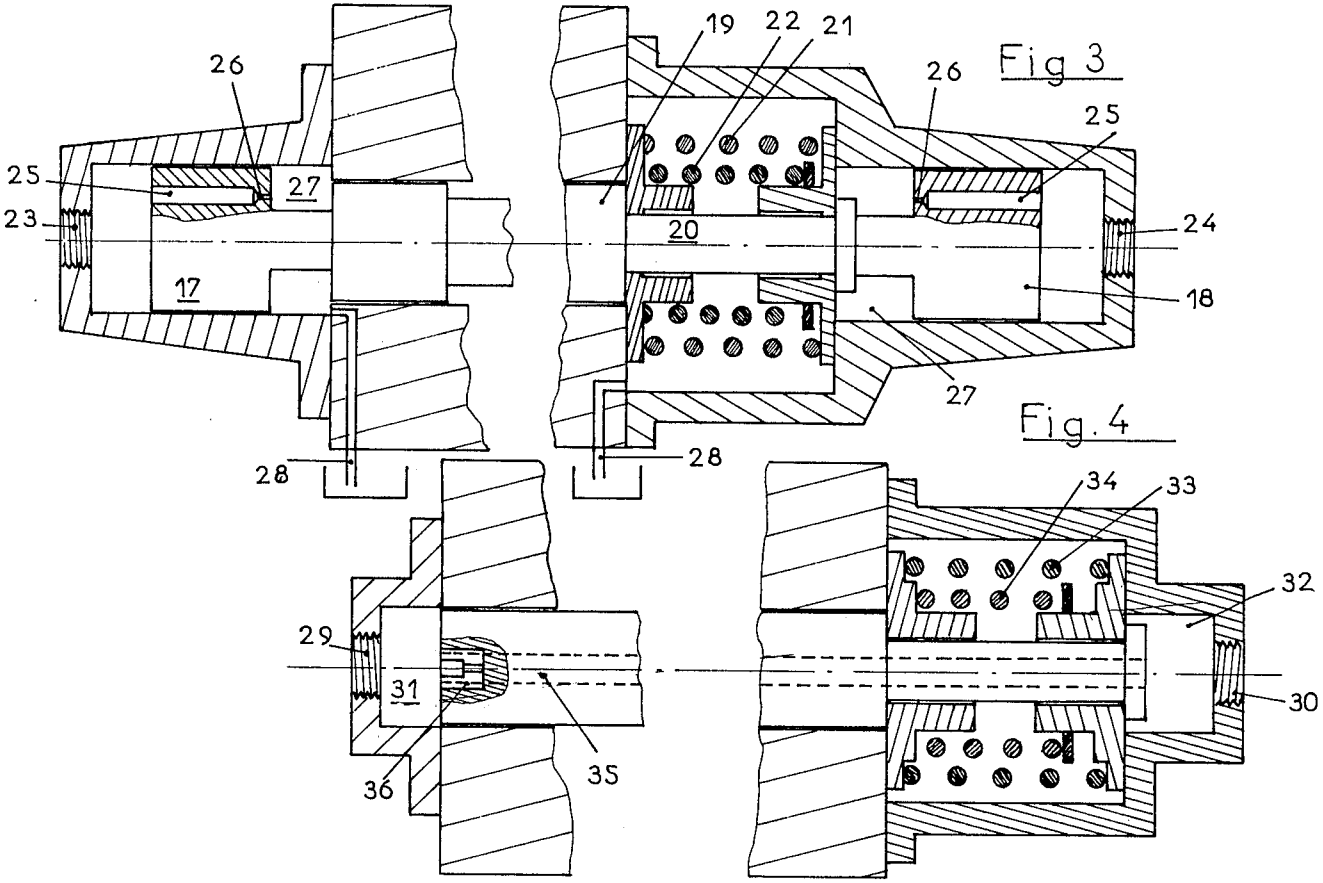
FIG. 3 is a partial section of a distributor of the type called "distributor piloted by the pistons."
FIG. 4 is a partial section of a distributor of the type called "distributor directly piloted bys the slide valve."

The distributor "piloted by the pistons " shown in FIG. 3 includes two pistons 17 and 18, which are connected to the slide valve 1 (partially shown) by the spindle 20. The springs 21 and 22 held the slide valve 19 in its central position in translation. The ends 23 and 24 are each connected to the outlet or feeding port 3 of an emitter (FIG. 1), and open on the outer faces of the pistons.

The novelty lies, first of all in the pistons 17 and 18, in each of which a hole 25 is drilled parallel to their longitudinal axis, said hole 25 including a calibrated port 26, which opens into a chamber 27 directly connected to an oil return channel 28 leading to the oil tank.

The operation is as follows:

The inlets 23 and 24 of said distributor are each connected to an emitter of the type illustrated in FIG. 1, that is "connected up, in use, to the fluid tank", according to a known method which allows manually operating two pistons simultaneously from a single lever.

When oil is sent into an inlet, such as for instance the inlet 23, the corresponding piston 17 is pushed back towards the center of the distributor. A certain amount of oil escapes through the jet 26 towards the outlet 28.

The novelty lies in the fact that the oil fows continuously through said jet 26 as long as a positive oil pressure is applied to the outer face of said piston.

The return of the slide valve 19 to its central position is brought about by the oil being discharged simultaneously:

through the outlet 4 of the emitter, through the jets 26 of the distributor.

The control is more rapid than that of the conventional arrangement, as the discharge takes place more rapidly.

According to a modified embodiment, each inlet of said distributor is simultaneously connected to several emitters of the type "not connected, in use, to the tank." The oil discharges takes place then only in the distributor, through the jets 26 and the channels 28.

This arrangement is advantageous, for instance, for an appliance which includes a cab or cage to be raised by means of jacks. Raising and lowering the cab can be controlled:

either from the ground, or from the cab itself.

The distributor "directly piloted by the slide valve" as shown in FIG. 4 includes two inlets 29 and 30 of the low presure oil control circuit. Said inlets 29 and 380 open each on a chamber 31 and 32, respectively. Said two chambers 31 and 32 each open directly on one of the ends of the slide valve (partially shown). The two springs 33 and 34 are disposed in a conventional way. On the other hand, a coaxial hole 35 is drilled throughout the length of the slide valve. One of the ends of said hole 35 is obturated by a jet 36.

The operation is as follows:

Each of the inlets 29 and 30 is connected to the port 3 (FIG. 1) of an emitter of the type called "connected up, in use, to the tank."

If the oil flow arrives, for instance, through the inlet 29, the slide valve is pushed back to a greater or lesser extent, depending on the intensity of the flow rate. A certain amount of oil flows through the jet 36 and the hole 35 towards the second inlet 30; from there, the flow takes place through the port 4 of the emitter which corresponds to said inlet 30.

This design is economical, as it allows using a distributor of more simple construction.

Figure 5:
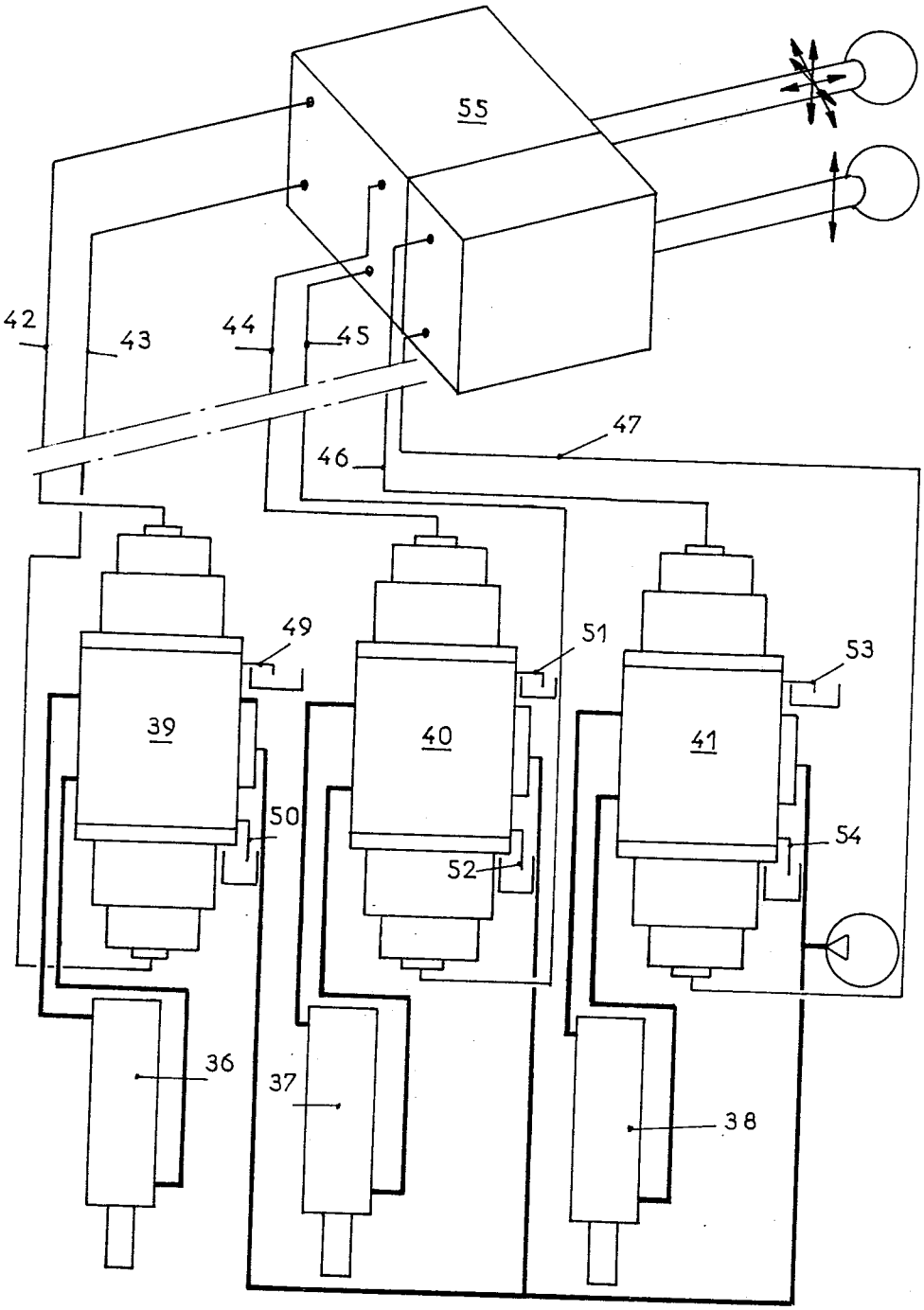
FIG. 5 is a diagrammatic representation of the connection of a control device having twos emitters, one of which groups four pistons, while the other one groups two pistons, so as to allow remotely controlling three power jacks.

The arrangement illustrated in FIG. 5 is constituted by three jacks 36, 37 and 38 controlled from a high pressure oil circuit by the distributors 39, 40 and 41. Such a disposition is already known. The jacks 36, 37 and 38 are of the type "piloted by the pistons"(FIG. 3). They are controlled (FIG. 5) by a low pressue circuit constituted by the admission lines 42, 43, 44, 45, 46 and 47, which are connected to an emitter 55 of the type "connected up, in use, to the fluid tank."

The novelty lies in the fact that the low pressue circuit is provided with outlets on the distributors, namely, the outlets 49, 50, 51, 52, 53 and 54.

The main advantage of said application is the reduction of the time of response of the control device with respect to the time of response of a conventional disposition.

The FIG. 5 embodiment thus depicts an application for controlling the same distributor from said different locations. The selective and proportional hydraulic remote control device illustrated in FIG. 5 includes jacks 36, 37 and 38 which are connected to a high pressure oil circuit commutated by the distributors 39, 40 and 41. Such distributors 39, 40 and 41 are remotely controlled by a low pressure circuit which is connected to the fluid emitter 55. Such fluid emitter 55 causes the input flow of the low pressure circuit for the distributors 39, 40 and 41 to vary. Only the input to the low pressure circuit takes place from the fluid emitter 55 through the connections 42, 43, 44, 45, 46 and 47, while the return to the tank takes place from the distributors 39, 40 and 41 through jets, the sections of which are fixed.

It is believed that with the above description and illustration, various features of the present invention will be apparent. For a definition of the scope of the invention, reference should be had to the appended claims.

We claim:

1. A fluid control device comprising, in combination:

a fluid emitter including body means and piston means;

a source of fluid operably connected to said fluid emitter;

said body means including a first port, a second port and a third port;

said piston means being mounted in said body means for displacement therein;

said piston means being normally biased to a first position so that the first port, through which fluid from said source of fluid may be introduced into said fluid emitter, is closed, while the fluid which may flow from the third port is permitted to leave said fluid emitter through said second port;

said piston means being movable by an external force to a second position so that fluid from said source of fluid which is introduced into said fluid emitter through said first port is permitted to leave said fluid emitter through said third port, while the second port is closed;

said piston means being provided with control means for varying the effective fluid communication passageway between said first port and said third port;

said fluid emitter allows in particular the admission of the fluid sent under low pressure toward a distributor connected to said fluid emitter through an inlet port of said distributor, wherein said distributor is adapted to control operation of power members, such as jacks or the like;

said control means adjusts the pressure to the inlet port of said distributor, while the pressure of an outlet port of said distributor is constant;

said control means which adjusts the pressure of the inlet port of said distributor are grouped inside said fluid emitter;

said fluid emitter includes a body provided with at least one hollow piston which slides inside an axial bore in said body;

said control means includes calibrated holes drilled in a radial direction in said piston;

a control lever is provided attached to said hollow piston; and the position of said control lever defines the number of said calibrated holes being obturated, the unobturated holes defining a section of said inlet port by opening in a chamber of pressure;

the fluid sent by said fluid emitter under low pressure acts on at least one piston connected to a slide valve of said distributor to control said slide valve;

said piston being provided with a hole parallel to its longitudinal axis; and said hole being provided with a jet through which a controlled flowing out of the low pressure fluid takes place.

* * * * *